United States Patent [19]

Tajima

[11] Patent Number: 4,495,876

[45] Date of Patent: Jan. 29, 1985

[54] EMBROIDERY MACHINE

[75] Inventor: Ikuo Tajima, Nagoya, Japan

[73] Assignee: Tokai Kogyo Mishin Kabushiki Kaisha, Aichi, Japan

[21] Appl. No.: 478,354

[22] Filed: Mar. 24, 1983

[30] Foreign Application Priority Data

| | | | |
|---|---|---|---|
| Apr. 8, 1982 | [JP] | Japan | 57-60213 |
| Apr. 10, 1982 | [JP] | Japan | 57-60048 |
| Apr. 19, 1982 | [JP] | Japan | 57-65991 |

[51] Int. Cl.[3] ..... D05C 9/04

[52] U.S. Cl. ..... 112/103; 112/121.11; 112/237

[58] Field of Search ..... 112/103, 102, 98, 121.11, 112/237, 86, 84

[56] References Cited

U.S. PATENT DOCUMENTS

| | | | |
|---|---|---|---|
| 1,328,821 | 1/1920 | Corrall | 112/103 |
| 2,896,562 | 7/1959 | Scheibel et al. | 112/103 |
| 4,208,975 | 6/1980 | Teetz | 112/103 X |
| 4,386,573 | 6/1983 | Davidson et al. | 112/103 |

*Primary Examiner*—H. Hampton Hunter

*Attorney, Agent, or Firm*—Dennison, Meserole, Pollack & Scheiner

[57] ABSTRACT

Disclosed herein is an embroidery machine having a table on which a cloth is spread to be fed, and a plurality of heads disposed above the table in parallel relation to each other, each of the heads having a needle for forming embroidery stitches on the cloth, the needle having an axis of rotation which is the origin of the X and Y axes of the Cartesian coordinates with respect to the table, including a frame placed on the table and horizontally movable in the directions of the X and Y axes in response to signals produced by a control unit for feeding the cloth; a feed plate provided horizontally under the cloth and adapted to move horizontally in the direction where the frame is moved and to return independently to its original position; and a cloth-pressing member vertically movably surrounding the needle for cooperating with the feed plate so as to tightly hold the cloth around the needle location therebetween, the cloth-pressing member being adapted to move horizontally in any direction around the needle and to return independently to its original position; the feed plate and the cloth-pressing member, when the frame moves horizontally, synchronously moving in the same direction where the frame moves; the cloth-pressing member moving upwardly to release the cloth around the needle location prior to the subsequent horizontal movement of the frame; and the feed plate and the cloth-pressing member returning to their respective original positions.

4 Claims, 12 Drawing Figures

EMBROIDERY MACHINE

BACKGROUND OF THE INVENTION

The present invention relates to an embroidery machine, and more particularly to an apparatus for feeding a cloth on which a pattern is embroidered by an embroidery machine.

SUMMARY OF THE INVENTION

According to the present invention, an embroidery machine having a table on which a cloth is spread to be fed, and a plurality of heads each having a needle and disposed above the table in parallel relation to each other, comprises a frame placed on the table and horizontally movable along the X and Y axes of the Cartesian coordinates the origin of which is the needle, in response to signals produced by a control unit for feeding the cloth, a feed plate provided horizontally under the cloth and synchronously movable in the direction where the frame is moved and then returning independently to it original position, and a cloth-pressing member vertically movably surrounding the needle and adapted to move horizontally in any direction around the needle and to return independently to its original position. When the frame moves horizontally, the feed plate and the cloth-pressing member which is lowered to cooperate with the feed plate so as to tightly hold the cloth around the needle location therebetween synchronously move in the direction where the frame moves. In advance of the subsequent horizontal movement of the frame, the cloth-pressing member moves upwardly to release the cloth around the needle location, and the feed plate and the cloth-pressing member return to the respective original positions. The feed plate is driven by a longitudinal feed motor and a transverse feed motor which are controlled in response to signals from the control unit. A mechanical means may be provided to return the feed plate, and in this case, a return shaft is connected to a feed motor for moving the feed plate and when the feed plate is moved, the feed motor imparts rotation on the return shaft. After the rotation, the return shaft is reversely rotated by a source of machine steady rotational drive connected to the return snhaft, and the reverse rotation of the return shaft becomes the output to return the feed plate. Further, when the feed plate is moved during the descent of the cloth-pressing member, the cloth-pressing member is horizontally displaced around the axis of rotation of the needle in consequence of the movement of the feed plate and returns centripetally to the axis of rotation of the needle, when it is moved upwardly to release the cloth.

Accordingly, it is the primary object of the present invention to provide a feeding apparatus for an embroidery machine which is adapted to precisely feed a cloth in accordance with a pattern to be embroidered.

It is another object of the present invention to provide a return system for a feed plate of the embroidery machine which is adapted to positively displace the feed plate to its original position after every horizontal movement of the feed plate abutting against the lower surface of the cloth to synchronously feed the cloth horizontally on the table in the tightly held condition around the needle location between the feed plate and the cloth-pressing member.

It is a further object of the present invention to provide a cloth-pressing mechanism for the embroidery machine which is useful to smoothly carry out the operations for repeatingly feeding the cloth, thereby improving precision movement of the cloth.

The present invention will become more fully apparent from the claims and the description as it proceeds in connection with the drawings.

DETAILED DESCRIPTION OF THE INVENTION

Figure 1:
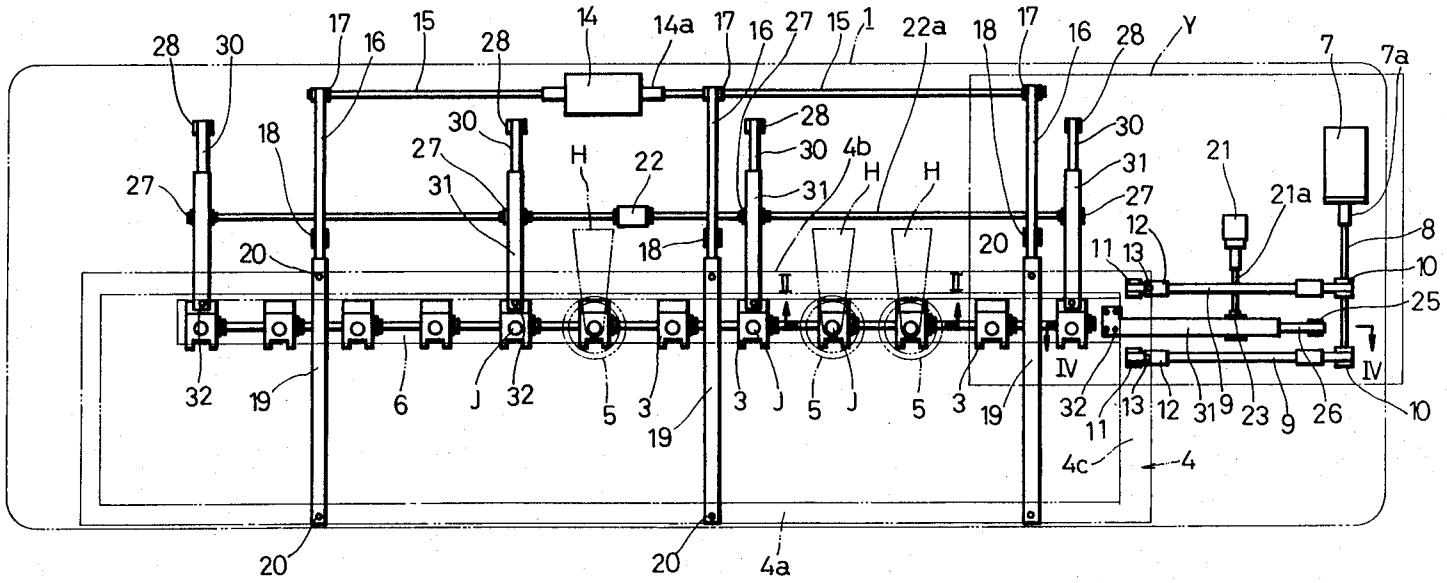
FIG. 1 is a whole plan view of a preferred embodiment of the present invention.
Figure 2:
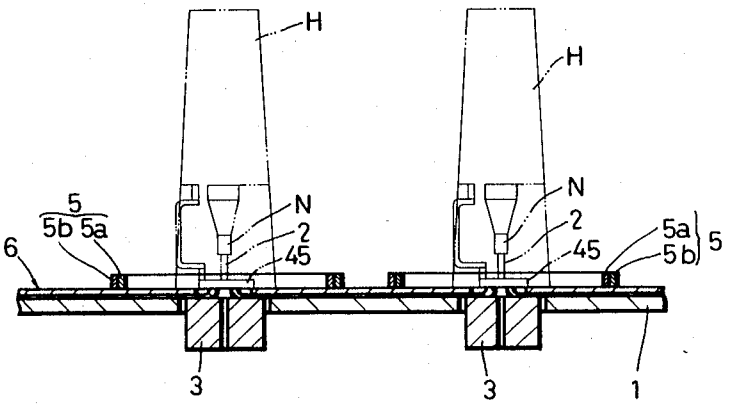
FIG. 2 is a sectional view taken along line II—II of FIG. 1.
Figure 4:
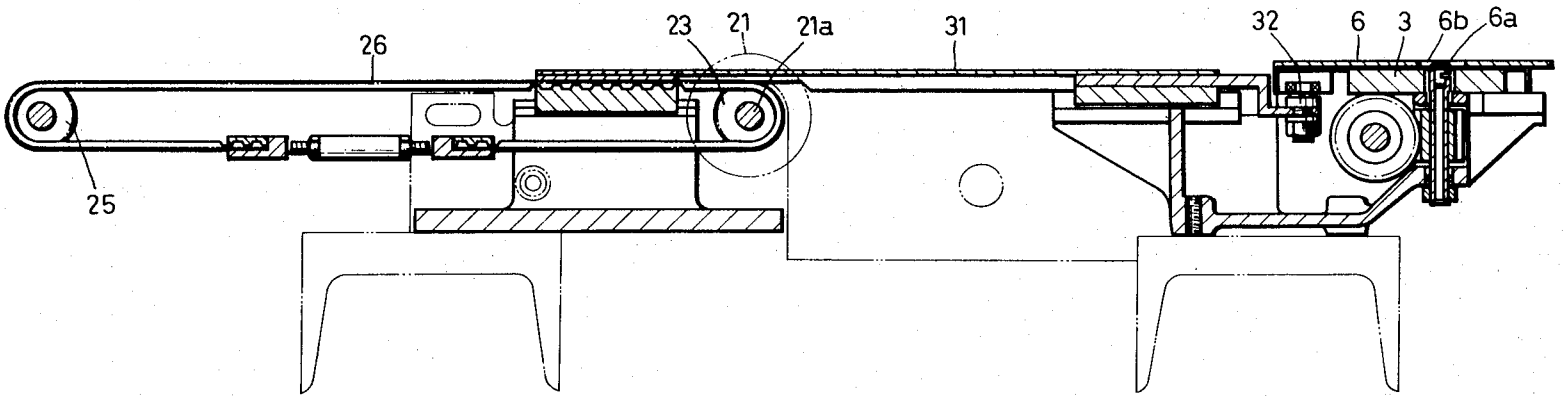
FIG. 4 is a sectional view taken along line IV—IV of FIG. 1.
Figure 3:
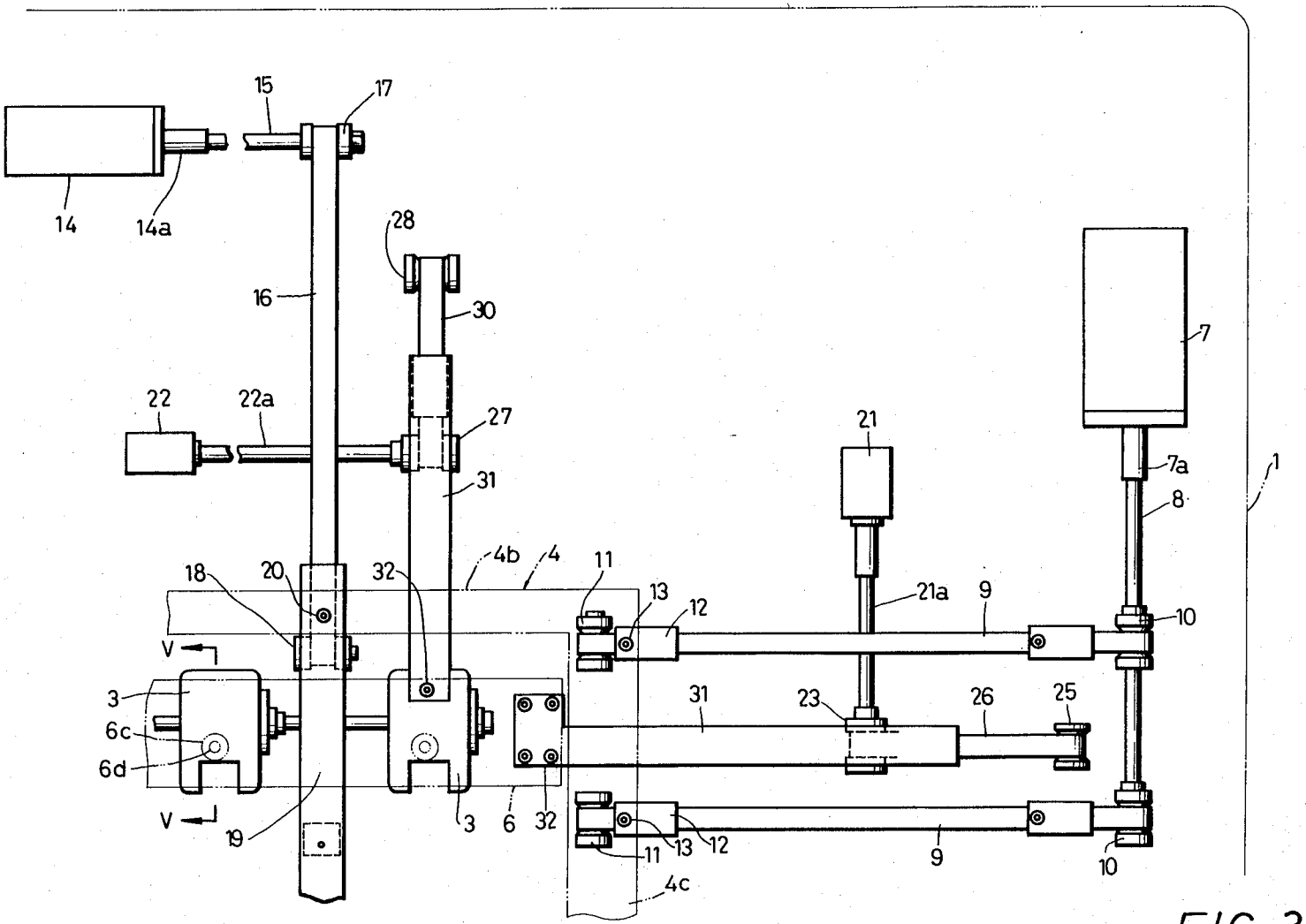
FIG. 3 is an enlarged view of the Y portion of FIG. 1.
Figure 5:
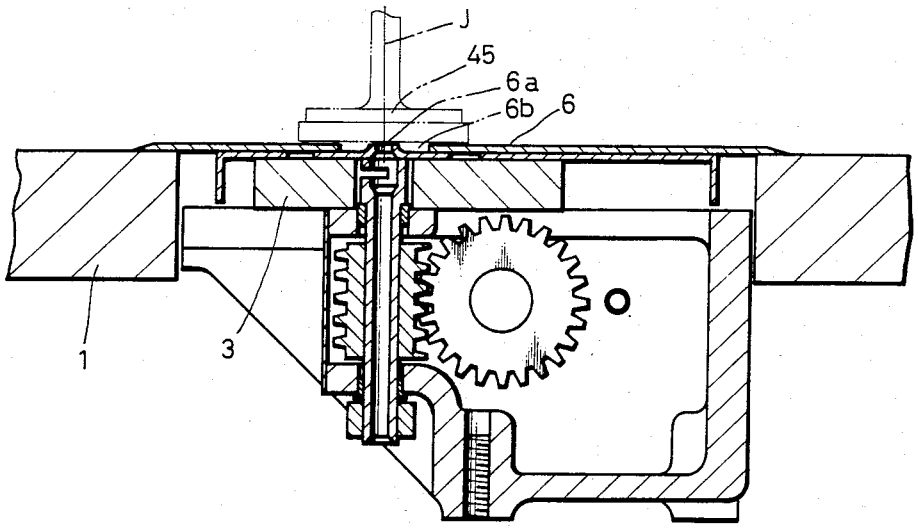
FIG. 5 is a sectional view taken along line V—V of FIG. 3.

In FIGS. 1 to 5 in which a multi-head type embroidery machine is shown as an embodiment of the present invention, numeral 1 designates a table of the machine having a plurality of heads H (some of them not shown for purposes of clarity) provided in parallel relation to one another thereabove. There are provided needles 2 perpendicular to the table 1 and vertically movably within the heads H. A nipple N is rotatably and vertically movably fitted on each needle 2.

Sewing bases 3 are disposed in parallel to one another, each opposite to the corresponding needle 2 and isolated from the table 1. The sewing base 3 is provided with a lower sewing mechanism which performs sewing operation in cooperation with the needle 2 to make embroidery stitches.

A rectangular frame 4 is placed horizontally movably on the table 1. In this embodiment, the frame 4 has a front bar 4*a* and a rear bar 4*b*, and tambours 5 each composed of an inner and outer circular members 5*a* and 5*b* and horizontally supported between the bars 4*a* and 4*b* in opposed relation to the corresponding head H so as to hold the cloth to be embroidered in the spread condition. (See FIG. 2.)

An oblong feed plate 6 crosses all of the sewing bases 3 from the right one to the left one, horizontally slidable along the upper surfaces of the bases 3. The feed plate 6 is laid under the cloth spread by each tambour 5 and has an interior hole 6*a* through which the needle 2 pases and an exterior hole 6*b* concentrically surrounding the interior hole 6*a* at each portion opposite to each head H. (See FIGS. 4 and 5.)

Numeral 7 designates a first longitudinal feed motor having an output shaft 7 connected to a transversely-disposed driving shaft 8. (See FIGS. 1 and 3.)

A pair of driving pulleys 10 are fitted on the driving shaft 8, and a pair of driven pulleys 11 are journaled in the lower portion of right bar 4*c* of the frame 4. A moving belt 9 is trained around each of the driving pulleys 10 and the corresponding driven pulley 11. A connecting plate 12 is secured on the upper run of the belt 9 around the left (as viewed in the drawing) end thereof. The connecting plate 12 has a connecting pin 13 projecting from the upper surface thereof which is adapted to be engaged with the right bar 4*c* of the frame 4 so as to longitudinally move the frame 4 and the moving belt 9 as a unit.

Numeral 14 designates a first transverse feed motor having a pair of output shafts 14*a* extending from both ends thereof, and each of the output shafts 14*a* is connected to a longitudinally-disposed driving shaft 15.

Driving pulleys 17 are fitted on the driving shafts 15, and driven pulleys 18 are journaled in the lower portion of the rear bar 4*b* of the frame 4. A moving belt 16 is trained around each driving pulley 17 and the corresponding driven pulley 18. A connecting plate 19 is secured on the upper run of the moving belt 16 around the front end thereof. The connecting plate 19 has a connecting pin 20 projecting from the upper surface thereof which is adapted to be engaged with the front and rear bars 4*a* and 4*b* of the frame 4 so as to move transversely the frame 4 and the belt 16 as a unit.

Figure 9:
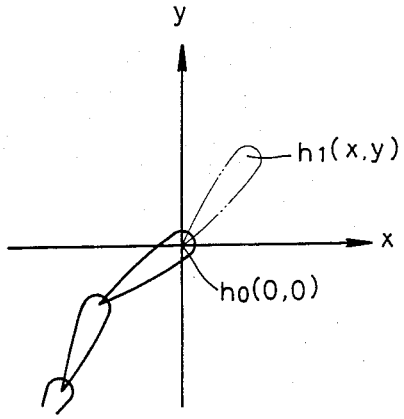
FIG. 9 is a view illustrating embroidery stitches.

When a control unit (not shown in the drawing) reads the travel data X and Y written in a tape or the like to generate X and Y signals to the first longitudinal feed motor 7 and the first transverse feed motor 14, the longitudinal feed motor 7 rotates in the forward or reverse direction in response to the X signal received by the motor 7 to move the frame 4 by the travel X responsive to the X signal along the X axis of the Cartesian coordinates supposed on the table whose origin is the axis of rotation J of the needle 2. The first transverse feed motor 14 also rotates in the forward or reverse direction in response to the Y signal received by the motor 14 to move the frame 4 by the travel Y responsive to the Y signal along the Y axis of the coordinates. Thus, the cloth is horizontally moved to displace the needle location h1 of the cloth where the subsequent descent of the needle makes a stitch from the coordinate point (X,Y) to the origin h0 (O,O). (See FIG. 9.)

Numeral 21 designates a second longitudinal feed motor adapted for moving the feed plate 6 along the X axis and numeral 22 designates a second transverse feed motor adapted for moving the feed plate 6 along the Y axis. The second longitudinal feed motor 21 has an output shaft 21*a* on which a driving pulley 23 is fitted, and a feed belt 26 is trained around the driving pulley 23 and a driven pulley 25 journaled at the right hand (as viewed in the drawing) of the driving pulley 23. The belt 26 is driven by the second longitudinal feed motor 21 under control responsive to the X signal. The second transverse feed motor 22 has an output shaft 22*a* on which driving pulleys 27 are fitted, and a driven pulley 28 is journaled at the back of each driving pulley 27. A feed belt 30 is trained around each driving pulley 27 and the corresponding driven pulley 28 and driven by the second transverse feed motor 22 under control responsive to the Y signal.

A connecting plate 31 is secured on the upper run of each of the feed belts 27 and 30. The connecting plate 31 has at the top end thereof a connecting pin 32 adapted for locking the connecting plate 31 to the lower surface of the feed plate 6. Thus, the feed plate 6 is connected to the feed belts 26 and 30 through the connecting plates 31 so as to be moved along the X and Y axes.

When the X and Y signals are outputted, the signals are transmitted to the second longitudinal feed motor 21 and the second transverse feed motor 22 to drive them for synchronous rotation in relation to the first longitudinal feed motor 7 and the first transverse feed motor 14. The feed plate 6, synchronized with the frame 4, is displaced by X and Y equal to the travels of the frame 4. When the needle goes upwardly after a stitch is made, −X and −Y signals which are inverse signals of X and Y are transmitted to the second longitudinal feed motor 21 and the second transverse feed motor 22 to drive tham in the reverse direction in response to the −X and −Y signals, and the feed plate 6 is moved along the X and Y axes by the return travels −X and −Y which correspond to the displacements X and Y, respectively, to return to its original position.

Figure 8:
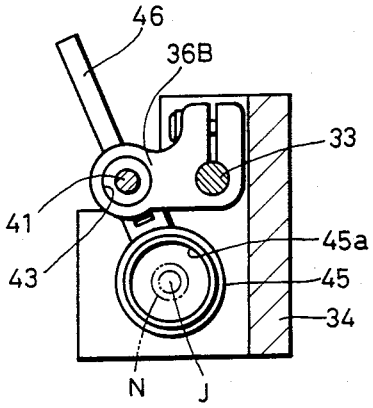
FIG. 8 is a sectional view taken along line III—III of FIG. 7.
Figure 6:
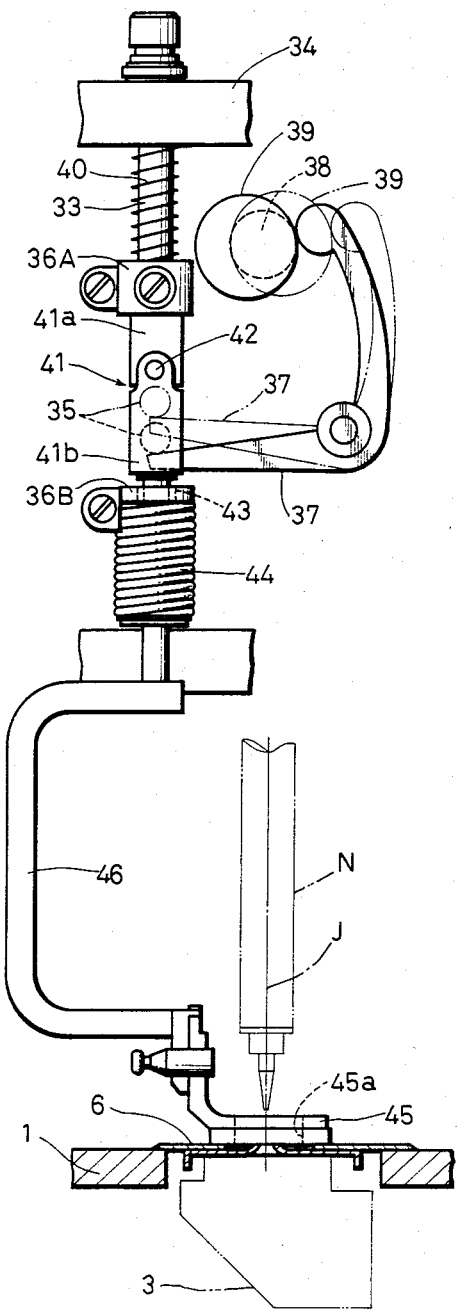
FIG. 6 is a side view of a cloth-pressing mechanism of the present invention.
Figure 7:
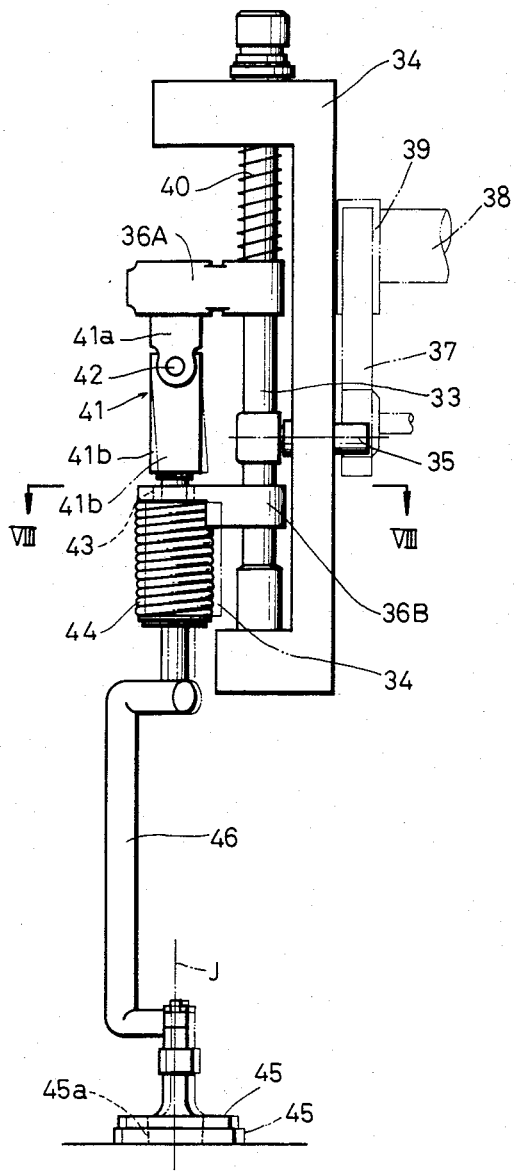
FIG. 7 is a front view of the cloth-pressing mechanism.

Referring to FIGS. 6, 7 and 8 which show a cloth-pressing mechanism, Numeral 33 designates an elevating bar vertically movably connected to the upper and lower ends of a holding bracket 34 secured to a head H. A connecting pin 35 is horizontally secured to the central portion of the elevating bar 33, and holding members 36A and 36B are secured to the elevating bar 33 above and below the connecting pin 35, projecting in the reverse direction to the connecting pin 35.

A swing arm 37 is secured to the head H by means of a pin, swingably movable opposite to the elevating bar 33. The swing arm 37 is swung abutting against a cam 39 fitted on a main shaft 38 which is steadily rotated to drive the needles and others. Swinging movement of the swing arm 37 causes vertical movement of the elevating bar 33 through the connecting pin 35, contracting and releasing a spring 40 encircling the upper portion of the elevating bar 33.

A universal joint 41 is vertically interposed between the upper and lower holding members 36A and 36B, and composed of upper and lower portions connected to each other through pins 42 and tiltingly movable in any direction. The uppermost end of the upper portion is fitted in the upper holding member 36A, while the lowermost end of the lower portion is loosely fitted in a hole 43 provided through the lower holding member 36B in such manner as to allow tilting movement of the lower portion around the fulcrum of the upper portion.

The lower portion of the universal joint 41 is connected at the lowermost end thereof to an resilient member 44 which is a coil spring in this embodiment. When the lower end of the resilient member 44 is horizontally displaced and then released, the resilient member 44 returns centripetally through its resilience to be held vertically.

A ring-like cloth-pressing member 45 is provided in opposed relation to the feed plate 6 and connected through a pressing bar 46 to the lowermost end of the resilient member 44. The cloth-pressing member 45 is placed on the upper surface of the feed plate 6 is such a way that the center of the hole of the cloth-pressing member 45 is on the axis of rotation J of the needle which vertically moves through the hole and the nipple N perpendicularly fitted on the needle and vertically and rotatingly movable. When the cloth-pressing member 45 descends in conjunction with the elevating bar 33, it tightly holds the cloth in cooperation with the feed plate 6, surrounding the portion around the needle location. When the feed plate 6 is moved, the cloth-pressing member 45 is horizontally displaced in accordance with the movement of the feed plate 6 under the influence of resilient deformity of the resilient member 44 to feed the cloth with the portion around the needle location kept in tightly held condition, while when the cloth-pressing member 45 ascends in conjunction with the elevating bar 33, it releases the cloth from the tightly held condition, and automatically returns centripetally to the axis of rotation J because of the recovering force of the resilient member 44.

In operation, when the needle goes upwardly and the control unit generates X and Y signals, the first longitudinal feed motor 7 and the first transverse feed motor 14 are rotated to move the frame 4 and consequently to feed the cloth in the direction composed of the travels along the X and Y axes responsive to the X and Y signals, respectively, and also the second longitudinal feed motor 21 and the second transverse feed motor 22 are rotated to synchronously move the feed plate 6 in the composite direction. The steady rotation of the main shaft 38 permits the cloth-pressing member 45 to be lowered through the elevating bar 33 until it is pressed against the feed plate 6, and is displaced in the composite direction along with the feed plate 6 to the cloth around the needle location which is tightly held between the cloth-pressing member 45 and the feed plate 6.

When the needle descends, the cloth-pressing member 45 is moved upwardly through the steady rotation of the main shaft 38 to release the cloth and returns centripetally from the position where the cloth-pressing member 45 is displaced to feed the cloth to its axis of rotation J under the influence of recovering force of the resilient member 44, and at the same time the second longitudinal feed motor 21 and the second transverse feed motor 22 are reversely driven by −X and −Y signals from the control unit to return the feed plate 6 from the displaced position to its original position. Thus, when the cloth is fed, the cloth is spread, the peripheral portion thereof being held by the tambour 5 and the portion around the needle location being tightly held, to achieve precise feed of the cloth. Even in case of the elastic fabric such as a knitted cloth, the cloth can be fed free from feed error or uneven feed caused by stretching of the cloth during the feeding operation. Consequently, the pattern accuracy embroidered on the cloth is extremely improved.

As the second longitudinal feed motor 21 and the second transverse feed motor 22 are rotated under control responsive to the signals from the control unit to displace the feed plate 6 along the X and Y axes and to return it to its original position after every movement, feed angle and travel of the cloth can be precisely achieved, and thus repeated feed operations will not cause accumulation of feed errors, whereby reproducibility of the embroidery pattern is improved and irregularity among the embroidered patterns will be reduced.

Furthermore, as the cloth-pressing member 45 smoothly and positively performs both of the reciprocal composite operations which consist of a composite operation to hold the cloth around the needle location and feed it; and a composite operation to release the cloth and return, the feed accuracy in the repeated feed operations will be extremely improved.

Figure 10:
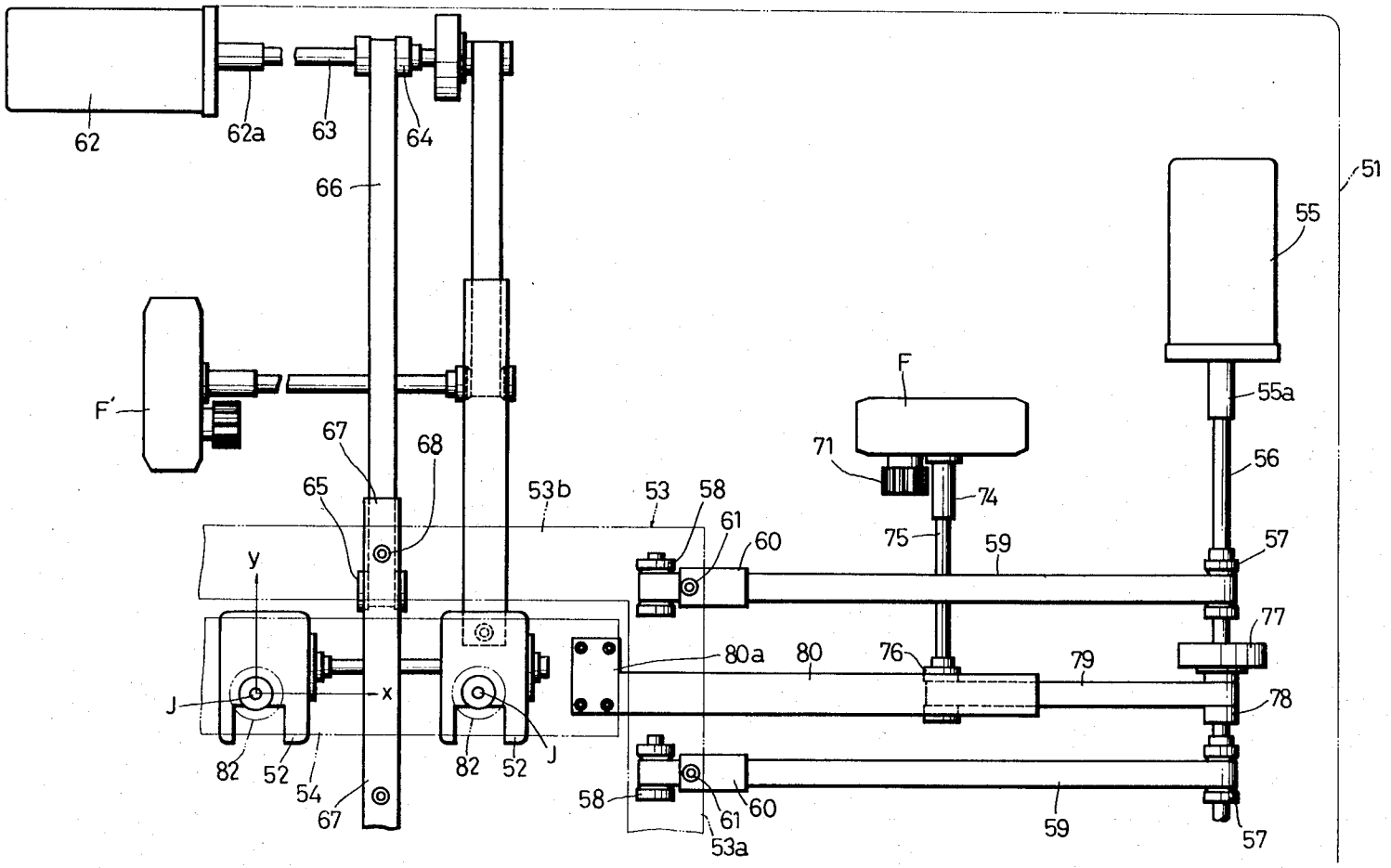
FIG. 10 is a plan view of the main part of the machine including a modified driving system for the feed plate.
Figure 11:
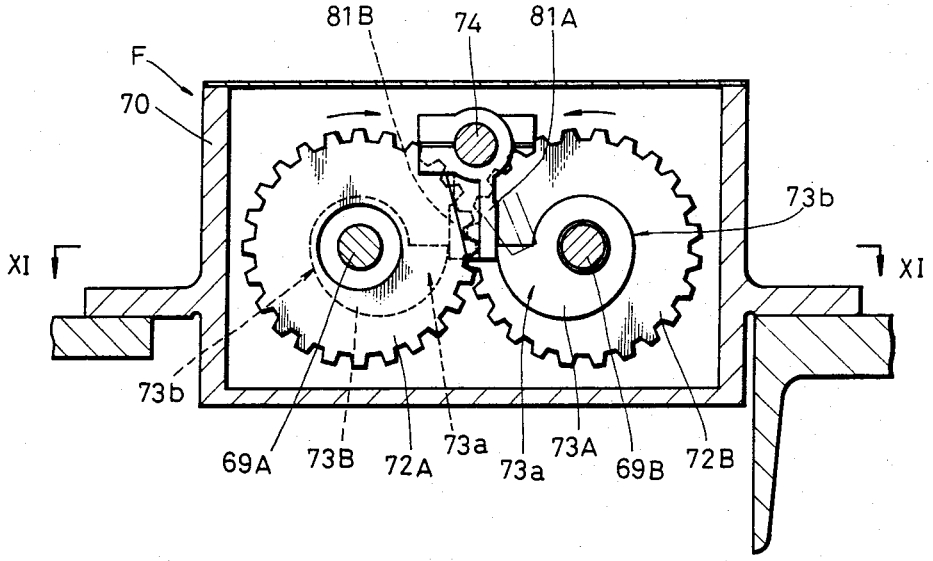
FIG. 11 is a vertical sectional view of a return assembly for returning the feed plate of the present invention.
Figure 12:
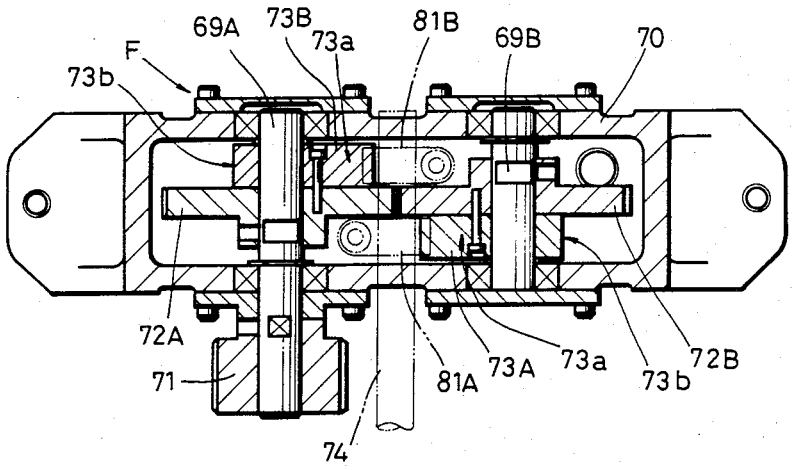
FIG. 12 is a sectional view taken along line XI—XI of FIG. 11.

FIGS. 10, 11 and 12 show a modified driving system for the feed plate according to the present invention. It is to be noted that the feed plate shown in FIG. 10 is returned to its original position through mechanical means, while the one shown in FIG. 1 is electrically driven.

Referring first to FIG. 10, shown therein and designated by the reference numeral 51 is a table of the machine. Sewing bases 52 are disposed in parallel to one another on the upper surface of the table 51 in opposed relation to heads H provided in parallel to one another above the table 51, and adapted for making stitches in cooperation with needles (not shown) which vertically moves at predetermined positions. A rectangular frame 53 is horizontally movably placed on the table 51 and adapted to hold the cloth in the spread condition on the table 51 in opposed relation to each head H.

An oblong feed plate 54 is provided inside of the frame 53 on the table 51, horizontally movable along the upper surfaces of the sewing bases 52. The feed plate 54 is brought in contact with the lower surface of the cloth held by the frame 53. A cloth-pressing member 82 is vertically movably provided above the feed plate 54, and descent of the cloth-pressing member 82 is synchronized with the movement of the feed plate 54 to tightly hold the cloth around the needle location between the feed plate 54 and the cloth-pressing member 82, and thereby to allow horizontal feed of the cloth during the movement of the feed plate 54.

Numeral 55 designates a longitudinal feed motor which is adapted to move the frame 53 along the X axis of the Cartesian coodinates supposed on the table 51 whose origin is the axis of rotation J of the needle, and driven for rotation under numerical control responsive to the X signal generated by a control unit (not shown).

The longitudinal feed motor 55 has an output shaft **55*a* which is connected to a driving shaft 56. Driving pulleys 57 are fitted on the driving shaft 56, and driven pulleys 58 are journaled in the lower portion of the right bar of the frame 53. A moving belt 59 is trained around each driving pulley 57 and the corresponding driven pulley 58, and a connecting plate 60 is attached on the upper run of the belt 59. The connecting plate 60 is connected at the right hand end thereof to the right bar 53*a* of the frame 53 through a connecting pin 61. As the frame 53 and the connecting plate 60 are connected to each other through the connecting pin 61 to move together, the frame 53 is moving along the X axis through the belt 59 during the rotation of the longitudinal feed motor 55**.

A transverse feed motor 62 is provided to move the frame 53 on the table 51 along the Y axis, and is driven for rotation under numerical control responsive to the Y signal from the control unit.

The transverse feed motor 62 has an output shaft **62*a* which is connected to a driving shaft 63. A driving pulley 64 is fitted on the driving shaft 63, and a driven pulley 65 is journaled in opposed relation to the driving pulley 64. A moving belt 66 is trained around the driving pulley 64 and the driven pulley 65, and a connecting plate 67 is attached on the upper run of the belt 66. The connecting plate 67 is connected to the front and rear bars 53*b* of the frame 53 through a connecting pin 68. As the frame 53 and the connecting plate 67 are connected through the connecting pin 68 to move together, the frame 53 is moved along the Y axis through the belt 66 during the rotation of the transverse feed motor 62**. Now, the synchronous movements along the X and Y axes are composed to horizontally feed the cloth to a determined embroidery position.

Now, the driving system for feeding and returning the feed plate 54 will be described. As the driving system for displacing the feed plate 54 along the X axis has the same construction as the one for displacing the feed plate 54 along the Y axis, the explanation will be given as to the driving system for feed along the X axis.

Referring to FIGS. 11 and 12 in particular, shown therein is a return assembly F provided near the longitudinal feed motor 55 shown in FIG. 10 and having a housing 70 and a pair of interlocking shafts 69A and 69B rotatably disposed left and right across the housing 70 in parallel to it. The steady rotation of the main shaft (not shown) is transmitted to the left interlocking shaft 69A through a gear 71 fitted on the front end of the left interlocking shaft 69A. Left and right gears 72A and 72B are fitted on the central portions of the left and right interlocking shafts 69A and 69B, respectively in such a manner as to engage with each other. The rotation of the left interlocking shaft 69A is transmitted through the gears 72A and 72B to the right interlocking shaft 69B in the reverse direction.

A front cam 73A is provided in front of the right gear 72A in parallel thereto, and a rear cam 73B is provided at the back of the left gear 72B in parallel thereto. The front and rear cams 73A and 73B, each having a thick portion **73*a* and a thin portion 73*b*, are bilaterally staggered. A return shaft 74 rotatably extends across the housing 70 around the central upper portion thereof in parallel to the left and right interlocking shafts 69A and 69B**.

Turning more specifically to FIG. 10, the return shaft 74 is connected at the front end thereof through a connecting shaft 75 to a return pulley 76 to be rotated together. A clutch 77 is fitted on the driving shaft 56, energized and deenergized in response to the X signal. A feed pulley 78 is loosely fitted on the driving shaft 56 to be rotatably along with the clutch 77 and disengaged from it. A feed belt 79 is trained around the return pulley 76 and the feed pulley 78. Thus, the return shaft 74 is disengagably coupled through the feed belt 79 with the longitudinal feed motor 55. A connecting plate 80 is attached to the upper run of the belt 79 and connected to the right end of the feed plate 54 through a connecting member **80*a* so as to connect the return shaft 74 and the feed plate 54 through the connecting plate 80 to be moved together. When the longitudinal feed motor 55 is rotated, the clutch 77 is energized by the X signal for controlling the rotation of the longitudinal feed motor 55 to transmit the rotation of the driving shaft 56 through the feed belt 79 to the feed plate 54. The feed plate 54 is moved along the X axis synchronously with the movement of the frame 53, and the return shaft 74 is subsequently rotated through the feed belt 79 by the angle proportional to the travel of the feed plate 54**.

With continuing reference to FIGS. 11 and 12, a pair of front and rear tilting arms 81A and 81B are fitted on the return shaft 74, tiltingly movable in opposed relation to the front and rear cams 73A and 73B, respectively. The relationship between the rotation of the front and rear cams 73A and 73B and the tilting movement of the left and right tilting arms 81A and 81B are set in such a way that rotation of the feed plate 54 causes tilting movement of the front and rear arms 81A and 81B, with the lower portions of the arms 81A and 81B abutting against the thin portions **73*b* of the front and rear cams 73A and 73B. When the longitudinal feed motor 55 is rotated in the clockwise direction to move the feed plate 54 in the plus direction along the X axis and subsequently the return shaft 74 is rotated in the clockwise direction, the rear tilting arm 81B inclined to the left hand abutting against the thin portion 73B of the rear cam 73B is pushed by the peripheral enlargement of the thick portion 73*a* of the rear cam 73B to the right hand until it stands substantially vertically, and the return shaft 74 is reversed in the counterclockwise direction by the rotational angle proportional to the travel of the feed plate 54. The reverse rotation of the return shaft 54 becomes the output to drive the feed belt 79, wherein the driving part is the return pulley 76 connected to the return shaft 74 and the driven part is the feed pulley 78 which is idly disengaged from the clutch 77 deenergized after the travel of the feed plate 54**. Then the feed plate is returned to its original position for the subsequent movement.

On the contrary, when the longitudinal feed motor 55 is rotated in the counterclockwise direction to move the the feed plate 54 in the minus direction along the X axis, the front tilting arm 81A inclined to the right hand is, in the same way, pushed by the thick portion **73*a* of the front cam 73A to be tiltingly moved in the clockwise direction, and the return shaft 74 is reversed. The reverse rotation of the return shaft 74 becomes the output to return the feed plate 54 to its original position through the feed belt 79**.

The feed plate 54 is at the same time displaced in the Y direction and returns in the same way as the displacement along the X axis by the driving system for the Y direction displacement having a return assembly F'. Thus, the feed plate 54 is moved in the direction composed of the displacements along the X and Y axes.

The mechanism described above, wherein the feed plate 54 is moved through the feed belt 79 which is connected to the feed plate 54 to move together, is operated as follows. The longitudinal feed motor 55 is connected to the return shaft 74 in such a manner that rotation of the longitudinal feed motor 55 will impart rotation on the return shaft 74, and the return shaft 74 is connected to the main shaft in such a manner that the return shaft 74 will be, after rotated, reversed by the steady rotation of the main shaft. The reverse rotation of the return shaft 74 becomes the output to retract the feed plate 54 through the feed belt 79.

Thus, the feed plate 54 is moved to feed the cloth, tightly holding the cloth around the needle location in cooperation with the cloth-pressing member 82 and, after every movement, returns to its original position for the subsequent feeding operation, and the series of the feeding operation can be smoothly and reliably repeated to embroider precise patterns on the cloths of various materials.

In this embodiment, the travel of the feed plate 54 is converted in the rotational angle of the return shaft 74 and the reverse rotation of the return shaft 74 by the angle causes precise return of the feed plate 54 to its original position.

While the invention has been described with reference to a few preferred embodiments thereof, it is to be understood that modifications or variations may be easily made without departing from the scope of this invention which is defined by the appended claims.

What is claimed is:

1. An embroidery machine having a table on which a cloth is spread to be fed, and a plurality of heads disposed above said table in parallel relation to each other, each of said heads having a needle for forming embroidery stitches on said cloth, said needle having an axis of rotation which is the origin of the X and Y axes of the Cartesian coordinates with respect to said table, comprising:

a frame placed on said table and means for horizontally moving said frame in the directions of said X and Y axes in response to signals produced by a control unit for feeding the cloth;

a feed plate provided horizontally under the cloth and means for moving said feed plate horizontally in the direction of movement of said frame and for returning said feed plate independently to its original position; and a cloth-pressing member surrounding said needle and means for vertically moving said cloth-pressing member for selective cooperating with said feed plate so as to tightly hold the cloth around the needle location therebetween, and means for allowing movement of said cloth-pressing member horizontally in any direction around said needle and for returning said cloth-pressing member independently to its original position;

wherein said feed plate and said cloth-pressing member, when said frame moves horizontally, synchronously moves in the same direction where said frame moves; and wherein said cloth-pressing member moves upwardly to release the cloth around the needle location prior to the subsequent horizontal movement of said frame; and said feed plate and said cloth-pressing member returning to their respective original positions after a stitch is made.

2. The embroidery machine as defined in claim 1, said means for moving said feed plate comprising a longitudinal feed motor controlled by signals from said control unit for moving said feed plate in the direction of said X axis and returning said feed plate to its original position; and a transverse feed motor controlled by signals from said control unit for moving said feed plate in the direction of said Y axis and returning said feed plate to its original position.

3. The embroidery machine as defined in claim 1, said means for moving said feed plate comprising:

a longitudinal feed motor for moving said feed plate in the direction of said X axis;

a transverse feed motor for moving said feed plate in the direction of said Y axis;

a first return assembly for returning said feed plate to its original position, said first return assembly having a first return shaft operatively connected at one end to said longitudinal feed motor and at its other end to a source of steady rotational drive for said embroidery machine; and a second return assembly for returning said feed plate to its original position, said second return assembly having a second return shaft operatively connected at one end to said transverse feed motor and at its other end to a source of steady rotational drive for said embroidery machine;

said first return shaft and said second return shaft, after rotation through said longitudinal feed motor and said transverse feed motor respectively, being adapted to be reversed;

whereby said first return shaft and said second return shaft, when reversed, each serves as an output to return said feed plate to its original position.

4. The embroidery machine as defined in claim 1 wherein when said feed plate is moved during the descent of said cloth-pressing member, said cloth-pressing member is horizontally displaced around the axis of rotation of said needle in accordance with the movement of said feed plate, and when said cloth-pressing member is moved upwardly to release the cloth, said cloth-pressing member returns centripetally to the axis of rotation of said needle.

* * * * *